US006270625B1

(12) United States Patent
Krukonis et al.

(10) Patent No.: US 6,270,625 B1
(45) Date of Patent: Aug. 7, 2001

(54) METHOD FOR MANUFACTURING COLORED STRIPPED PAPER

(75) Inventors: Kenneth A. Krukonis, Canal Winchester, OH (US); Charles E. Nelson, Neenah; Mark R. Kleman, Appleton, both of WI (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/342,284

(22) Filed: Jun. 29, 1999

(51) Int. Cl.[7] ..... D21H 21/28; D21H 23/04

(52) U.S. Cl. ..... 162/162; 162/140; 162/134; 162/183; 162/126

(58) Field of Search ..... 162/162, 140, 162/134, 216, 343, 265, 135, 183, 275, 185, 126, 123; 283/67, 72, 95–97, 117, 901; 8/919, 637.1

(56) References Cited

U.S. PATENT DOCUMENTS

| | | | | |
|---|---|---|---|---|
| 1,790,822 | * | 2/1931 | Ledeboer | 162/162 |
| 1,889,953 | * | 12/1932 | Dankert | 162/162 |
| 2,032,385 | * | 3/1936 | Wood | 162/140 |
| 3,049,468 | * | 8/1962 | Hinton et al. | 162/162 |
| 4,202,852 | * | 5/1980 | Pauls et al. | 264/115 |
| 4,383,834 | * | 5/1983 | Degen et al. | 8/551 |
| 4,888,094 | * | 12/1989 | Weisshuhn et al. | 162/198 |
| 4,897,158 | * | 1/1990 | Weisshuhn et al. | 162/259 |
| 4,940,512 | | 7/1990 | Hendren et al. | 162/109 |
| 5,196,091 | * | 3/1993 | Hergert | 162/258 |
| 5,549,792 | * | 8/1996 | Begemann et al. | 162/216 |
| 5,626,722 | * | 5/1997 | Huovila | 162/343 |
| 5,707,495 | * | 1/1998 | Heinzmann et al. | 162/343 |
| 5,814,191 | * | 9/1998 | Huovila | 162/216 |
| 5,853,545 | * | 12/1998 | Haraldsson et al. | 162/343 |
| 5,900,121 | * | 5/1999 | Lehleiter et al. | 162/322 |
| 5,958,189 | * | 9/1999 | Begemann et al. | 162/264 |
| 5,989,389 | * | 11/1999 | Sundberg | 162/109 |
| 6,033,444 | * | 3/2000 | Ahlinder | 8/637.1 |
| 6,117,272 | * | 9/2000 | Heinzmann | 162/216 |

FOREIGN PATENT DOCUMENTS

| | | | | |
|---|---|---|---|---|
| 4417461A1 | | 11/1995 | (DE) . | |
| 1078 | * | 10/1895 | (GB) | 162/162 |
| 696673 | * | 9/1953 | (GB) | 162/140 |

OTHER PUBLICATIONS

Schultz, H.–J., "Der BTF–Zentralverteiler–Schwingungsdämpferals Voraussetzung für gleichmäBige Papierqualität (The BTF Central Distributor Attenuator as a Condition for Continuous Paper Quality)," Wochenblatt Für Papierfabrikation Nov./Dec.–1997, pp. 558–562.

Schultz, Dr. –Ing. Hans Joachim, "The First Dilution Headbox of the World," XIV Imeko World Congress CD Symposium, Jun. 4.–5, 1997, Tampere Finland.

Schultz, Dr. –Ing. Hans–Joachim, "BTF's system overcomes asymmetrical paper faults," World Pulp and Paper Technology, 1995/1996, pp. 104–106.

* cited by examiner

*Primary Examiner*—Jose Fortuna
(74) *Attorney, Agent, or Firm*—Thompson Hine LLP

(57) ABSTRACT

A method for manufacturing paper having colored stripes, the method comprising the steps of feeding a slurry to a distributor and delivering the slurry from the distributor to a headbox through a plurality of delivery lines. The delivery lines are coupled to the headbox at a plurality of locations spaced across the headbox in a crossmachine direction. The method further comprises the steps of selectively introducing a first coloring agent in at least two of the delivery lines to selectively color the slurry passing through the at least two delivery lines and depositing the slurry received by the headbox on a papermaking wire to form striped paper.

29 Claims, 1 Drawing Sheet

METHOD FOR MANUFACTURING COLORED STRIPPED PAPER

The present invention is directed to a method for manufacturing colored striped paper or security paper, and more particularly, to a method for manufacturing colored striped paper by introducing one or more coloring agents to the pulp before the pulp enters the headbox.

BACKGROUND OF THE INVENTION

Paper is typically manufactured by forming a pulp slurry, which is a mixture of fibers suspended in a solution of primarily water. The fibers can be, for example, cellulose-based fibers (i.e. wood fibers), in which case the slurry is termed pulp slurry. Once the pulp or slurry is produced, it is fed to a distribution system that includes a dilution water header, a distributor, and a headbox. The distributor receives the incoming pulp slurry and is typically utilized to normalize the properties of the slurry, such as its consistency, pressure, and velocity. The dilution water header supplies dilution water that is used to control the consistency of the pulp exiting the distributor. Flow exiting the distributor is fed through a plurality of delivery lines that deliver the flow to a series of nozzles distributed across the headbox. The nozzles deposit the slurry, in "jet" form, onto a moving papermaking "wire" to form a sheet on the papermaking wire. The sheet is then dewatered, pressed, dried, and treated to form the finished product.

It may be desired to make colored paper that has stripes that extend in the machine direction (i.e. extend in the longitudinal direction of the deposited sheet). However, in order to make colored paper in conventional papermaking systems, dyes, pigments or other colorants are added to the pulp slurry such that all of the pulp slurry is dyed, and the resultant paper web is uniformly colored throughout its thickness. This method does not allow for the selective introduction of color, and therefore the color of the finished paper product is limited to a single shade or color. Some paper mills produce paper sheets having a colored "marbled" appearance. These sheets are manufactured by drizzling small droplets of dye from a pipe located a few inches above the freshly deposited pulp on the wire. This method of dye application produces a random marbled appearance and does not produce a striped paper. In addition, the marbled coloring is located predominately on the top side of the sheet, and is not uniformly distributed throughout the thickness of the paper. Furthermore, when the paper is cut or torn, the uncolored sublayers of the paper become visible. Accordingly, there is a need for a method of manufacturing machine direction striped paper that is colored throughout the entire thickness of the sheet.

SUMMARY OF THE INVENTION

The present invention is a method for manufacturing colored striped paper, wherein the colored portions of the paper are colored throughout the thickness of the paper. Paper produced with the inventive method may be used to manufacture printing and writing paper, text, cover, and other specialty grades of paper. The method of the present invention may also be used to produce security paper that is used in the production of documents to help verify the documents' validity, such as checks, tickets, legal documents, personal identifications, and the like. The present invention adds color to the slurry before the slurry is introduced to the headbox in such a way that the colored and uncolored fibers form a sheet of paper having a machine direction striped pattern throughout the entire thickness of the sheet. The method of the present invention can be practiced by modifying some specific types of existing paper manufacturing equipment, and thus is quick and relatively inexpensive to implement.

Besides adding colorants, the method may also be used to introduce nearly any additive that varies the characteristics of the paper in the cross machine direction. For example, security additives may be added to the paper to help identify documents for security purposes.

In particular, the present invention is a method for manufacturing paper having colored stripes, the method comprising the steps of feeding a slurry to a distributor and delivering the slurry from the distributor to a headbox through a plurality of delivery lines. The delivery lines are coupled to the headbox at a plurality of locations spaced across the headbox in a crossmachine direction. The method further comprises the steps of selectively introducing a first coloring agent in at least two of the delivers lines to selectively color the slurry, passing through the at least two delivery lines and depositing the slurry received by the headbox on a papermaking wire to form striped paper.

Other objects and advantages of the present invention will be apparent from the following description and the accompanying drawings.

DETAILED DESCRIPTION

Figure 1:
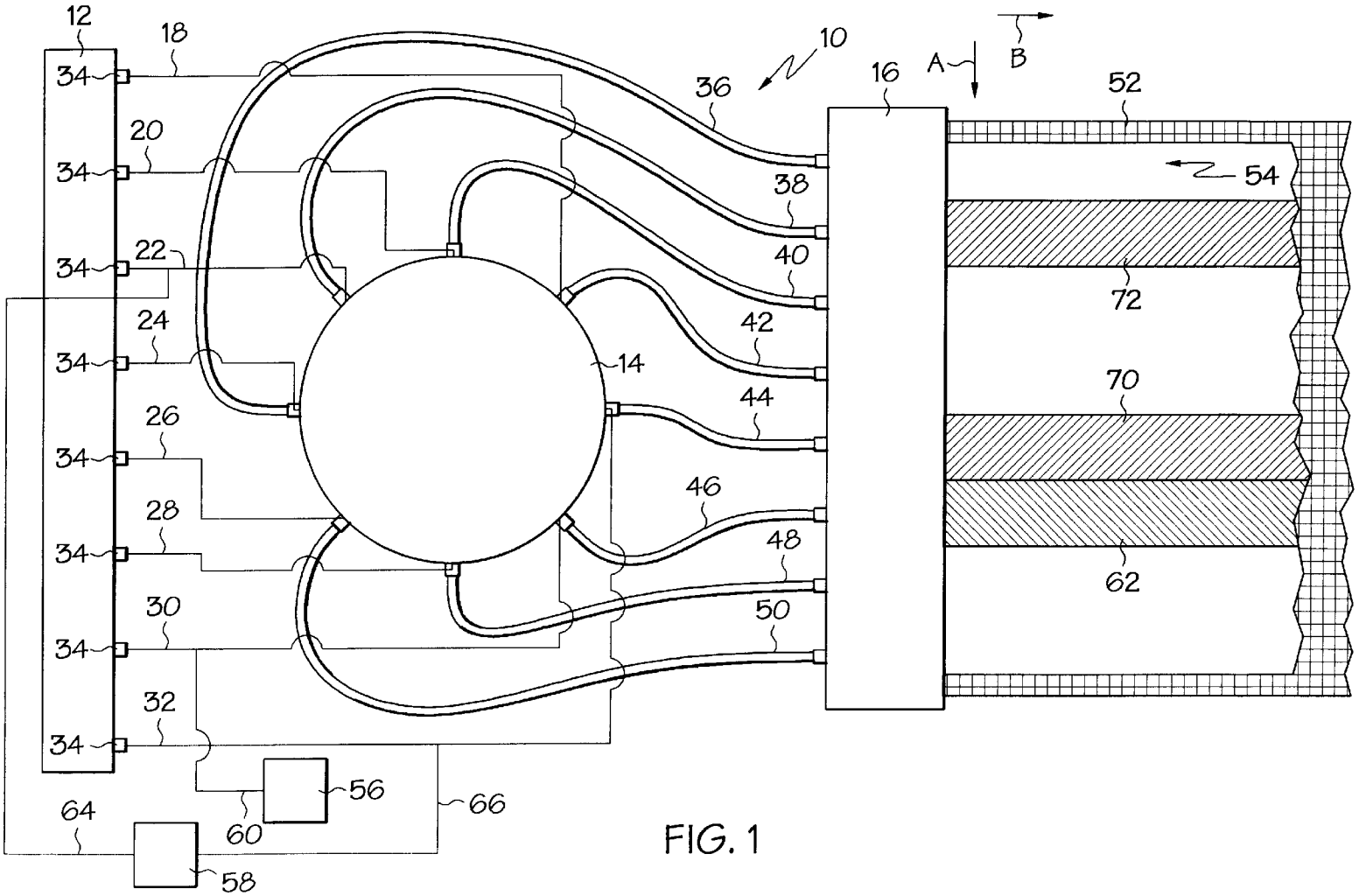
FIG. 1 is a top, schematic view illustrating a system for implementing the method of the present invention.

As shown in FIG. 1, the system 10 of the present invention may be implemented using a dilution water header 12, a distributor 14 and a headbox 16. The distributor 14 receives a flow of pulp slurry from a pressure screen (not shown). The distributor 14 feeds the pulp slurry to the headbox 16 through a plurality of delivery lines 36, 38, 40, 42, 44, 46, 48, 50, and the delivery lines preferably distribute the pulp slurry evenly across the width of the headbox 16. The distributor 14 normalizes the properties (such a velocity, pressure, consistency, and the like) of the pulp slurry flow. In one embodiment the distributor 14 is a generally cylindrical container. The distributor 14 may be any of a variety of commercially available distributors. In a preferred embodiment, the distributor 14 is part of an attenuator-distributor system manufactured by, or under a licensing agreement with, Brunnenmuhle Technologie fur Faserprodutke GmbH (BTF) of Germany.

The dilution water header 12 is used to selectively dilute the pulp slurry in the distributor 14 immediately before the pulp slurry enters one of the delivery lines 36, 38, 40, 42, 44, 46, 48, 50. The dilution water header 12 supplies fresh water or paper machine "white water" to the pulp slurry in the distributor 14 to selectively dilute the pulp slurry. The dilution water header 12 is coupled to the distributor 14 by a plurality of dilution water lines 18, 20, 22, 24, 26, 28, 30, 32. The dilution water lines 18, 20, 22, 24, 26, 28, 30, 32 deliver the fresh water or white water from the dilution water header 12 to the distributor 14, and the flow of water through the dilution water lines is controlled by hand-actuated or automatic valves 34.

The flow of pulp in the distributor 14 is mixed with the dilution water from the dilution water header 12 as desired. In this manner the consistency or the percentage of solids of the pulp slurry exiting the distributor and flowing through the delivery lines is controlled through the addition of water from the dilution water lines. The diluted pulp slurry flow is then delivered to the head box 16 via the delivery lines 36, 38, 40, 42, 44, 46, 48, 50. The flow from each dilution water line 18, 20, 22, 24, 26, 28, 30, 32 is deposited inside the distributor 14 in close proximity to the inlet for an associated delivery line 36, 38, 40, 42, 44, 46, 48, 50. Thus, flow from a single dilution water line is fed into an associated delivery line. In other words, each dilution water line is dedicated to a single delivery line. Thus, for example, substantially all of the flow in dilution line 18 is fed into delivery line 42.

The delivery lines are located around the periphery of the distributor 14, and are coupled to the headbox 16 at a plurality of locations generally equally spaced across the headbox 16 in a crossmachine direction (indicated by arrow A). The pulp flow delivered to the headbox 16 is deposited onto a synthetic forming "wire" 52 in a wet sheet form. The wire 52 is moved or conveyed in a downstream direction (i.e. in the machine direction indicated by arrow B) and carries the deposited pulp slurry 54 away from the headbox 16 for dewatering, pressing, drying, and further treatment to form the finished paper product. The pulp slurry delivered by each delivery line 36, 38, 40, 42, 44, 46, 48, 50 contributes to a portion of the width of the deposited pulp 54 in the crossmachine direction.

One or more colorant sources 56, 58 are preferably coupled to at least two of the dilution water lines 18, 20, 22, 24, 26, 28, 30. Two colorant sources 56, 58 are shown in FIG. 1, although greater or lesser numbers of colorant sources may be utilized without departing from the scope of the invention. Each colorant source 56, 58 includes a pump and tank (not shown) that contains a coloring agent suspended or dissolved in a fluid to form a coloring suspension or solution. The coloring agent may include any composition that can change the color of the pulp slurry, including but not limited to anionic or cationic direct dyes, solvent dyes, pigments, and colored or dyed fibers. The coloring agents are preferably water soluble and dissolved or suspended in a water base, but the coloring agent may also be non-water soluble and dissolved or suspended in a non-water base. The term "coloring solution" is used herein to describe a coloring agent that is either suspended or dissolved in a carrier. The coloring solution preferably includes about 0.5% to about 50% by volume of the coloring agent. The coloring solution is preferably added to the water dilution lines at a rate of about 0.5 to 4.0 gallons per hour (31 ml/minute to 252 ml/minute).

The colorant sources 56, 58 may be coupled to the dilution water lines by a T-fitting, Y-fitting, or other 3 port fitting (not shown). The coloring solution is fed from the colorant source 56, 58 to the dilution water lines by one or more pumps (not shown) via a colorant line 60, 64, 66. In this manner, when a coloring solution is introduced into one or more of the dilution water lines 18, 20, 22, 24, 26, 28, 30, 32, the coloring solution and coloring agent mixes with the water in the dilution water line. The water in the dilution lines 18, 20, 22, 24, 26, 28, 30, 32 then carries the coloring solution to the distributor 14, where the coloring solution is introduced into the pulp at the inlet of an associated delivery line 36, 38, 40, 42, 44, 46, 48, 50. Thus, when the coloring solution in one of the dilution water lines is mixed with the pulp in a delivery line, the pulp in the delivery line is colored by the coloring agent from the dilution water line. Finally, the diluted, colored pulp in the delivery lines 36, 38, 40, 42, 44, 46, 48, 50 is deposited as pulp slurry 54 on the wire 52. In this manner, selected portions of the deposited pulp slurry 54 are colored by the coloring agents from the colorant sources 56, 58. Therefore the deposited pulp slurry 54, and the resultant paper product, has stripes that extend in the machine direction. Each stripe in the paper is formed primarily by the pulp slurry contributed by a delivery line 36, 38, 40, 42, 44, 46, 48, 50 that has a colorant added therein.

For example, FIG. 1 illustrates one particular method for striping paper. The colorant source 56 is coupled to the dilution water line 30 by a colorant line 60. When coloring agent from the colorant source 56 is introduced in the dilution water line 30, the water in the dilution water line 30 mixes with the coloring agent, or acts as a carrier for the coloring agent. The water in dilution water line 30 in then fed to the distributor 14. The dilution water then mixes with a portion of pulp slurry in the distributor that is located immediately upstream of the inlet for the delivery line 46. The diluted, colored pulp flows into the associated delivery line 46. The colored pulp in delivery line 46 is then deposited on the wire 52, which results in the stripe 62. Similarly, the colorant source 58 is coupled to dilution water lines 22, 32 by colorant lines 64, 66. The pulp slurry deposited on the wire 52 by the associated delivery lines 38, 44 is colored by the coloring agent from the colorant source 56 to form stripes 70, 72. The color of each stripe 62, 70, 72 preferably has a color that is discreet from the areas surrounding the stripe. That is, the colored stripe is either flanked by non-colored portions of the paper, or by one or two other colored stripes, or by an edge of the paper.

It should be noted that after the pulp slurry 54 is deposited on the wire 52, the pulp contributed by a delivery line with colorant therein may tend to slightly diffuse into the surrounding pulp. This may result in color that fades or bleeds at the outer edges of the stripes. This may be a desirable effect in the finished paper product. The amount of bleeding or lateral mixing can be controlled by adjusting the pulp consistency, dye pump flow, paper machine speed (i.e. speed of travel of the wire), or a combination of these factors. Each of the dilution water lines 18, 20, 22, 24, 26, 28, 30, 32 preferably includes a 3-way fitting such that a colorant line can be connected to the dilution water lines. However less than all of the dilution water lines may include a fitting. As shown in FIG. 1, a single colorant source (58) may be coupled to more than one dilution line. Preferably each colorant source 56, 58 includes a different color or shade so that paper including a variety of colors and shades may be produced.

Other types of additives may be added to the paper, such a security additives, to improve the anti-counterfeiting features of the paper. For example, colored fibers, security dye suspensions, planchettes, metallic fibers, RF fibers, dyed synthetic fibers or small specks of paper having various geometric shapes and the like may be added to the slurry in the same manner that colorants were added above. Furthermore, additives that respond to ultraviolet light, phosphors, or phosphorescent additives may also be utilized. The security additives maybe suspended in a water base, and added to the dilution water lines in the same manner as the coloring agents. The security additives may also be introduced into one or more of the dilution water lines or delivery lines by adding the security additives to the coloring solution before the coloring solution is introduced into the dilution water lines. The presence of the security additives, or the presence of a particular striped pattern of the security additives, can be used to identify the validity of documents or papers, and thereby help screen out counterfeit papers. Furthermore, the present invention may be used with nearly any additive to vary the characteristics of the paper in a cross machine direction for various purposes.

In an alternate embodiment, the colorant lines 60, 64, 66 may be coupled to one or more of the delivery lines 36, 38, 40, 42, 44, 46, 48, 50 to add colorants or security additives directly to the delivery lines.

Having described the invention in detail and by reference to the preferred embodiments, it will be apparent that modifications and variations thereof are possible without departing from the scope of the invention.

What is claimed is:

1. A method for manufacturing paper having colored stripes comprising the steps of:

feeding a slurry to a distributor;

delivering said slurry from said distributor to a headbox through a plurality of delivery lines, said delivery lines being coupled to said headbox at a plurality of locations spaced across said headbox in a crossmachine direction;

selectively introducing a first coloring agent in at least two of said delivery lines at said distributor to selectively color the slurry passing through said at least two delivery lines; and depositing said slurry received by said headbox on a papermaking wire to form striped paper.

2. The method of claim 1 wherein said first coloring agent is dissolved or suspended in a fluid to form a coloring solution before said introducing step, and wherein said coloring solution is introduced in said at least two delivery lines to selectively introduce said first coloring agent in said at least two delivery lines.

3. The method of claim 2 wherein said coloring solution is added to said at least two delivery lines at a rate of between about 0.5 and about 4 gallons per hour.

4. The method of claim 2 wherein said first coloring agent constitutes about 0.5 percent to about 50.0 percent concentration by volume of said coloring solution.

5. The method of claim 1 wherein the slurry in said at least two delivery lines is diluted by dilution water, and wherein said dilution water selectively introduces said first coloring agent in said at least two delivery lines.

6. The method of claim 1 wherein a plurality of dilution water lines are coupled to said plurality of delivery lines, said dilution water lines delivering dilution water to said plurality of delivery lines, and wherein said dilution water lines selectively introduce said first coloring agent in said at least two delivery lines.

7. The method of claim 6 wherein each delivery line receives dilution water from an associated, dedicated dilution water line.

8. The method of claim 6 wherein each dilution water line delivers said dilution water from a water header to said delivery lines.

9. The method of claim 6 wherein said first coloring agent is dissolved or suspended in a fluid to form a coloring solution, and wherein said coloring solution is introduced into selected ones of said plurality of dilution water lines to selectively introduce said first coloring agent in said at least two delivery lines.

10. The method of claim 9 wherein said coloring solution is pumped into said selected dilution water lines to thereby introduce said first coloring agent into said selected dilution water lines.

11. The method of claim 9 wherein said selected dilution water lines each include a 3-way fitting to enable said first coloring agent to be introduced therein.

12. The method of claim 1 wherein the slurry delivered by each delivery line contributes to a portion of the width of the deposited slurry in the crossmachine direction.

13. The method of claim 1 wherein said slurry is comprised of cellulose fibers suspended in a water base.

14. The method of claim 1 wherein said first coloring agent is a dye.

15. The method of claim 1 wherein said first coloring agent is a pigment.

16. The method of claim 1 further comprising the step of suspending said first coloring agent in a liquid base before said first coloring agent is introduced into said at least two delivery lines.

17. The method of claim 1 further comprising the step of moving said wire to convey said deposited slurry away from said headbox.

18. The method of claim 17 wherein said paper is striped in a direction parallel to the movement of said wire.

19. The method of claim 17 further comprising the step of controlling the speed of said wire to control the diffusion of the colored slurry deposited on said wire.

20. The method of claim 1 further comprising the step of selectively introducing a second coloring agent into another one of said plurality of delivery lines before said depositing step.

21. The method of claim 20 wherein the pulp colored by said second coloring agent has a shade or color different from the pulp colored by said first coloring agent.

22. The method of claim 1 further comprising the step of controlling the consistency of the slurry deposited on said wire to control the diffusion of the colored slurry deposited on said wire.

23. The method of claim 1 wherein said plurality of locations are generally evenly spaced across said headbox.

24. The method of claim 1 wherein said selectively introducing step includes introducing said first coloring agent into said distributor adjacent to said at least two delivery lines such that said first coloring agent flows out of said distributor and substantially into said at least two delivery lines.

25. A method for manufacturing striped paper comprising the steps of:

feeding a slurry to a distributor;

delivering said slurry from said distributor to a headbox through a plurality of delivery lines, said delivery lines being coupled to said headbox at a plurality of locations spaced across said headbox in a crossmachine direction;

selectively introducing a first coloring agent in said distributor and into a first of said delivery lines to selectively color the slurry passing through said first delivery line;

selectively introducing a second coloring agent in said distributor and into a second of said delivery lines to selectively color the slurry passing through said second delivery line; and depositing said slurry received by said headbox on a papermaking wire to form striped paper.

26. The method of claim 25 wherein the portion of said slurry deposited on said wire by said first delivery line is spaced from the portion of said slurry deposited on said wire by said second delivery line in a crossmachine direction.

27. A method for manufacturing paper having colored stripes comprising the steps of:

feeding a slurry to a distributor;

delivering said slurry from said distributor to a headbox through a plurality of delivery lines, said delivery lines being coupled to said headbox at a plurality of locations spaced across said headbox in a crossmachine direction;

providing a plurality of dilution water lines, each dilution water line being coupled to said distributor and in fluid communication with an associated delivery line;

selectively introducing a coloring agent at least one of said dilution water lines to color the slurry in at least two of said delivery lines; and depositing said slurry received by said headbox on a papermaking wire to form striped paper.

28. The method of claim 27 wherein the water in each dilution water line is dedicated to an associated delivery line.

29. The method of claim 28 wherein each dilution water line supplies dilution water to each associated delivery line.

* * * * *

UNITED STATES PATENT AND TRADEMARK OFFICE

CERTIFICATE OF CORRECTION

PATENT NO. : 6,270,625 B1
DATED : August 7, 2001
INVENTOR(S) : Kenneth A. Krukonis et al.

It is certified that error appears in the above-identified patent and that said Letters Patent is hereby corrected as shown below:

Title page,
Title, the word "STRIPPED" should be -- STRIPED --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*